US011191325B2

(12) United States Patent
Hetrich

(10) Patent No.: US 11,191,325 B2
(45) Date of Patent: Dec. 7, 2021

(54) HARNESS CONNECTION ARRANGEMENT

(71) Applicant: MSA Technology, LLC, Cranberry Township, PA (US)

(72) Inventor: Mitchell H. Hetrich, Greenville, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 510 days.

(21) Appl. No.: 15/952,809

(22) Filed: Apr. 13, 2018

(65) Prior Publication Data

US 2019/0313746 A1 Oct. 17, 2019

(51) Int. Cl.

| | |
|---|---|
| ***A44B 11/28*** | (2006.01) |
| ***A62B 35/00*** | (2006.01) |
| ***A44B 13/00*** | (2006.01) |
| ***A44B 11/04*** | (2006.01) |

(52) U.S. Cl.

CPC ..... *A44B 11/28* (2013.01); *A44B 11/04* (2013.01); *A44B 13/0029* (2013.01); *A62B 35/0018* (2013.01); *A62B 35/0025* (2013.01); *A44D 2200/10* (2013.01)

(58) Field of Classification Search

CPC ..... A44B 11/28; A44B 11/04; A44B 13/0029; A62B 35/0018; A62B 35/0025; A44D 2200/10

See application file for complete search history.

(56) References Cited

U.S. PATENT DOCUMENTS

| | | | | | |
|---|---|---|---|---|---|
| 390,280 | A | * | 10/1888 | Budd | A44B 11/28 24/312 |
| 814,464 | A | * | 3/1906 | Maltby | A44B 11/28 24/310 |
| 1,494,610 | A | * | 5/1924 | Mcglashan | A44B 11/28 24/687 |
| 1,772,393 | A | * | 8/1930 | Guttman | A44B 11/28 24/601.8 |
| 3,482,288 | A | * | 12/1969 | Curran | A44B 11/28 24/310 |

(Continued)

FOREIGN PATENT DOCUMENTS

| | | |
|---|---|---|
| CA | 2504473 A1 | 10/2005 |
| CA | 2488288 A1 | 5/2006 |

(Continued)

*Primary Examiner* — Colleen M Chavchavadze
*Assistant Examiner* — Candace L Bradford
(74) *Attorney, Agent, or Firm* — The Webb Law Firm

(57) ABSTRACT

A connection arrangement for use with a wearable body harness has a first connector having a body with a first portion of a locking mechanism and a second connector having a body with a second portion of the locking mechanism. The first portion of the locking mechanism has a tab connected to the body of the first connector and a slot having a first portion extending through the body of the first connector and a second portion extending through the tab. The second portion of the locking mechanism has a tongue configured for being received through the first portion of the slot, and an intermediate connecting element having a first end connected to the body of the second connector and a second end connected to the tongue. The second end of the intermediate connecting element is offset from the body of the second connector.

17 Claims, 9 Drawing Sheets

(56) References Cited

U.S. PATENT DOCUMENTS

| | | | | |
|---|---|---|---|---|
| 4,502,192 | A * | 3/1985 | Hess | A44B 11/2588 24/589.1 |
| 4,713,864 | A * | 12/1987 | Hess | A44C 5/2057 24/589.1 |
| 6,457,774 | B2 | 10/2002 | Baloga | |
| 7,144,086 | B1 | 12/2006 | Harcourt et al. | |
| 7,252,342 | B2 | 8/2007 | Patrizi et al. | |
| D595,183 | S * | 6/2009 | Nelson | D11/212 |
| 8,328,289 | B2 | 12/2012 | Tharp | |
| 8,408,656 | B2 | 4/2013 | Carpenter | |
| 8,418,898 | B2 | 4/2013 | Carlsson et al. | |
| 8,974,005 | B2 | 3/2015 | Mason et al. | |
| 9,067,561 | B2 | 6/2015 | Crews | |
| 9,174,071 | B2 | 11/2015 | Seman et al. | |
| 9,192,145 | B2 | 11/2015 | Kissel, Jr. | |
| 9,399,417 | B1 | 7/2016 | Grey et al. | |
| 9,457,208 | B2 | 10/2016 | Seman et al. | |
| 9,713,968 | B1 | 7/2017 | Richardson et al. | |
| 2005/0121568 | A1* | 6/2005 | Youngberg | F24H 9/06 248/154 |
| 2006/0005293 | A1 | 1/2006 | Frey et al. | |
| 2006/0102423 | A1 | 5/2006 | Lang et al. | |
| 2008/0155792 | A1* | 7/2008 | Yeh | A44B 11/04 24/169 |
| 2010/0025148 | A1 | 2/2010 | Dawson | |
| 2010/0244543 | A1 | 9/2010 | Fine et al. | |
| 2011/0113520 | A1 | 5/2011 | Dennis | |
| 2015/0191147 | A1 | 7/2015 | Cobb | |
| 2015/0296929 | A1* | 10/2015 | Kung | A44B 11/28 24/164 |
| 2016/0059053 | A1 | 3/2016 | Seman et al. | |
| 2017/0049218 | A1 | 2/2017 | Moncreiff | |
| 2018/0055153 | A1* | 3/2018 | Ressler | A44B 11/04 |
| 2018/0125173 | A1* | 5/2018 | Lambert | A44B 11/28 |
| 2020/0155879 | A1* | 5/2020 | Chang | A62B 35/0037 |

FOREIGN PATENT DOCUMENTS

| | | | | |
|---|---|---|---|---|
| CA | 2573356 | C | 3/2014 | |
| CA | 2672244 | C | 9/2014 | |
| CA | 2792321 | C | 4/2015 | |
| DE | 9400218 | U1 * | 2/1994 | A44B 11/2584 |
| DE | 9400218 | U1 | 2/1994 | |
| EP | 1162107 | A2 | 12/2001 | |
| EP | 2724752 | B1 | 3/2017 | |
| EP | 3017847 | B1 | 7/2017 | |
| WO | 2006017350 | A1 | 2/2006 | |
| WO | 2015166224 | A1 | 11/2015 | |

* cited by examiner

HARNESS CONNECTION ARRANGEMENT

BACKGROUND OF THE INVENTION

Field of the Invention

The present invention relates generally to wearable body harnesses and, in particular, to a harness connection arrangement for use with wearable body harnesses.

Description of the Related Art

As is known in the art, there exist various safety devices and arrangements that can be worn by or attached to a user to ensure the wearer's safety in certain situations. Such mechanisms come in many forms, including, but not limited to, harnesses and safety belts. Full body harnesses are widely used for lifting and lowering individuals in dangerous situations and as a primary component in a personal fall arrest system. These harnesses can also be used for work positioning, travel restriction, ladder climbing, rescue retrieval, and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

While there are many variations in full body harness construction, all typically include a plurality of elongate straps that are combined together to fit around a user's body. In some embodiments or aspects, a full body harness may have an attachment point (D-ring) typically positioned in a central portion of the user's back or chest, and a plurality of straps routed around predetermined portions of the user's body in such a manner as to hold or suspend the user in the event of a fall. One or more straps of the harness may be removably connected together by a connector, such as a buckle.

While a variety of connectors exist in the art for connecting the straps f the harness, there is a continued need in the art for improved connectors. For example, there is a need for improved connectors that prevent tangling of harness straps. There is a further need in the art for improved connectors that can be easily and effectively connected and disconnected to allow quick donning and removal of the harness. There is also a need for improved connectors with increased safety compliance and redundant safety mechanisms.

SUMMARY OF THE INVENTION

Generally, provided is an improved body harness having an improved harness connection arrangement. Preferably, provided is an improved harness having a harness connection arrangement that can be easily and effectively worn by the user in a variety of work environments without compromising the user's ability to move. Preferably, provided is a harness having a connector for connecting at least two straps of the harness, wherein the connector can be easily and effectively connected and disconnected to allow quick donning and removal of the harness. Preferably, provided is an improved harness having a harness connection arrangement that not only leads to increased safety compliance at the worksite, but also provides increased effectiveness and safety to the user.

In some preferred and non-limiting embodiments or aspects, a connection arrangement for use with a wearable body harness may have a first connector having a body with a first portion of a locking mechanism, and a second connector having a body with a second portion of the locking mechanism. The first portion of the locking mechanism may have a tab connected to the body of the first connector and angled at a predetermined angle relative to a plane defined by the body, and a slot having a first portion extending through the body of the first connector and a second portion extending through the tab. The second portion of the locking mechanism may have a tongue configured for being received through the first portion of the slot, and an intermediate connecting element having a first end connected to the body of the second connector and a second end connected to the tongue. The second end of the intermediate connecting element may be offset from the body of the second connector such that the intermediate connecting element is receivable in the second portion of the slot on the tab.

In other preferred and non-limiting embodiments or aspects, the first portion of the locking mechanism may be configured for interacting with the second portion of the locking mechanism to removably engage the first connector and the second connector between a first, locked configuration, where the first connector and the second connectors are connected to each other, and a second, unlocked configuration, where the first connector and the second connectors are disconnected from each other. The predetermined angle may be 30° to 180°. The first portion of the slot may have an angled end surface that is angled at an angle of 90° to 180° relative to lateral surfaces of the first portion of the slot. A width of the first portion of the slot may be narrower than a width of the tongue. A width of the second portion of the slot may be wider than a width of the intermediate connecting element. The tongue may be connected to the intermediate connecting element along a first elongated side that is wider than a width of the intermediate connecting element. The first elongated side may have a first portion overlapping a first side of the intermediate connecting element and a second portion overlapping a second side of the intermediate connecting element. A width of the first portion of the first elongated side may be shorter than a width of the second portion of the first elongated side.

In other preferred and non-limiting embodiments or aspects, the body of each of the first connector and the second connector may have at least one fixed buckle configured for receiving at least a portion of a harness webbing therethrough. The at least one fixed buckle may have a bar spaced apart from the body of each of the first connector and the second connector by a gap and a pair of posts connecting terminal ends of the bar to the body of each of the first connector and the second connector. The body of each of the first connector and the second connector may have at least one adjustable buckle configured for receiving at least a portion of a harness webbing therethrough. The adjustable buckle may have an adjustment mechanism configured for adjusting a position of at least one strap of the harness by selective frictional engagement with the at least one strap of the harness. The adjustment mechanism may have a frame connected at its terminal ends to the body of each of the first connector and the second connector with an opening between a central portion of the frame and the body of each of the first connector and the second connector. The adjustment mechanism further may have an adjustment bar extending across the opening and movably engaged with the terminal ends of the frame. The adjustment bar may have an elongated body with terminal ends curved in a direction toward one another. The frame may have a lifting tab configured as an arcuate bend in the frame. The body of at least one of the first connector and the second connector may be substantially planar. The connection arrangement may further have a relief opening extending through the body of at least one of the first connector and the second connector.

In other preferred and non-limiting embodiments or aspects, a wearable body harness having a plurality of straps may have a first shoulder strap and a second shoulder strap, a first connector on the first shoulder strap, and a second connector on the second shoulder strap. The first connector may have a body with a first portion of a locking mechanism, and the second connector may have a body with a second portion of the locking mechanism. The first shoulder strap and the second shoulder strap may be removably connectable to each other with engagement of the first connector and the second connector. The first portion of the locking mechanism may have a tab connected to the body of the first connector, and a slot having a first portion extending through the body of the first connector and a second portion extending through the tab. The second portion of the locking mechanism may have a tongue configured for being received through the first portion of the slot on the first connector, and an intermediate connecting element having a first end connected to the body of the second connector and a second end connected to the tongue. The second end of the intermediate connecting element may be receivable in the second portion of the slot on the tab.

In other preferred and non-limiting embodiments or aspects, the first shoulder strap may have a first portion connected to a first end of the first connector and a second portion connected to a second end of the first connector, and the second shoulder strap may have a first portion connected to a first end of the second connector and a second portion connected to a second end of the second connector. The first shoulder strap and the second shoulder strap may be arranged in an X-shaped configuration at a front portion of the harness.

Further preferred and non-limiting embodiments or aspects will now be set forth in the following numbered clauses.

Clause 1: A connection arrangement for use with a wearable body harness, the connection arrangement comprising: a first connector having a body with a first portion of a locking mechanism; and a second connector having a body with a second portion of the locking mechanism, wherein the first portion of the locking mechanism comprises: a tab connected to the body of the first connector and angled at a predetermined angle relative to a plane defined by the body, and a slot having a first portion extending through the body of the first connector and a second portion extending through the tab, and wherein the second portion of the locking mechanism comprises a tongue configured for being received through the first portion of the slot, and an intermediate connecting element having a first end connected to the body of the second connector and a second end connected to the tongue, the second end of the intermediate connecting element being offset from the body of the second connector such that the intermediate connecting element is receivable in the second portion of the slot on the tab.

Clause 2: The connection arrangement of clause 1, wherein the first portion of the locking mechanism is configured for interacting with the second portion of the locking mechanism to removably engage the first connector and the second connector between a first, locked configuration, where the first connector and the second connector are connected to each other, and a second, unlocked configuration, where the first connector and the second connector are disconnected from each other.

Clause 3: The connection arrangement of clause 1 or 2, wherein the predetermined angle is 30° to 180°.

Clause 4: The connection arrangement of any of clauses 1-3, wherein the first portion of the slot has an angled end surface that is angled at an angle of 90° to 180° relative to lateral surfaces of the first portion of the slot.

Clause 5: The connection arrangement of any of clauses 1-4, wherein a width of the first portion of the slot is narrower than a width of the tongue.

Clause 6: The connection arrangement of any of clauses 1-5, wherein a width of the second portion of the slot is wider than a width of the intermediate connecting element.

Clause 7: The connection arrangement of any of clauses 1-6, wherein the tongue is connected to the intermediate connecting element along a first elongated side that is wider than a width of the intermediate connecting element.

Clause 8: The connection arrangement of any of clauses 1-7, wherein the first elongated side has a first portion overlapping a first side of the intermediate connecting element and a second portion overlapping a second side of the intermediate connecting element.

Clause 9: The connection arrangement of any of clauses 1-8, wherein a width of the first portion of the first elongated side is shorter than a width of the second portion of the first elongated side.

Clause 10: The connection arrangement of any of clauses 1-9, wherein the body of each of the first connector and the second connector comprises at least one fixed buckle configured for receiving at least a portion of a harness webbing therethrough.

Clause 11: The connection arrangement of any of clauses 1-10, wherein the at least one fixed buckle has a bar spaced apart from the body of each of the first connector and the second connector by a gap and a pair of posts connecting terminal ends of the bar to the body of each of the first connector and the second connector.

Clause 12: The connection arrangement of any of clauses 1-11, wherein the body of each of the first connector and the second connector comprises at least one adjustable buckle configured for receiving at least a portion of a harness webbing therethrough, the adjustable buckle having an adjustment mechanism configured for adjusting a position of at least one strap of the harness by selective frictional engagement with the at least one strap of the harness.

Clause 13: The connection arrangement of any of clauses 1-12, wherein the adjustment mechanism comprises a frame connected at its terminal ends to the body of each of the first connector and the second connector with an opening between a central portion of the frame and the body of each of the first connector and the second connector, and an adjustment bar extending across the opening and movably engaged with the terminal ends of the frame.

Clause 14: The connection arrangement of any of clauses 1-13, wherein the adjustment bar has an elongated body with terminal ends curved in a direction toward one another.

Clause 15: The connection arrangement of any of clauses 1-14, wherein the frame has a lifting tab configured as an arcuate bend in the frame.

Clause 16: The connection arrangement of any of clauses 1-15, wherein the body of at least one of the first connector and the second connector is substantially planar.

Clause 17: The connection arrangement of any of clauses 1-16, further comprising a relief opening extending through the body of at least one of the first connector and the second connector.

Clause 18: A wearable body harness having a plurality of straps comprising: a first shoulder strap and a second shoulder strap; a first connector on the first shoulder strap, the first connector having a body with a first portion of a locking mechanism; and a second connector on the second shoulder strap, the second connector having a body with a second portion of the locking mechanism, wherein the first shoulder strap and the second shoulder strap are removably connectable to each other with engagement of the first connector and the second connector, and wherein the first portion of the locking mechanism comprises: a tab connected to the body of the first connector, and a slot having a first portion extending through the body of the first connector and a second portion extending through the tab, and wherein the second portion of the locking mechanism comprises: a tongue configured for being received through the first portion of the slot on the first connector, and an intermediate connecting element having a first end connected to the body of the second connector and a second end connected to the tongue, the second end of the intermediate connecting element being receivable in the second portion of the slot on the tab.

Clause 19: The wearable body harness of clause 18, wherein the first shoulder strap has a first portion connected to a first end of the first connector and a second portion connected to a second end of the first connector, and wherein the second shoulder strap has a first portion connected to a first end of the second connector and a second portion connected to a second end of the second connector.

Clause 20: The wearable body harness of clause 18 or 19, wherein the first shoulder strap and the second shoulder strap are arranged in an X-shaped configuration at a front portion of the harness.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

In FIGS. 1-7E, like characters refer to the same components and elements, as the case may be, unless otherwise stated.

DETAILED DESCRIPTION OF THE INVENTION

Figure 1:
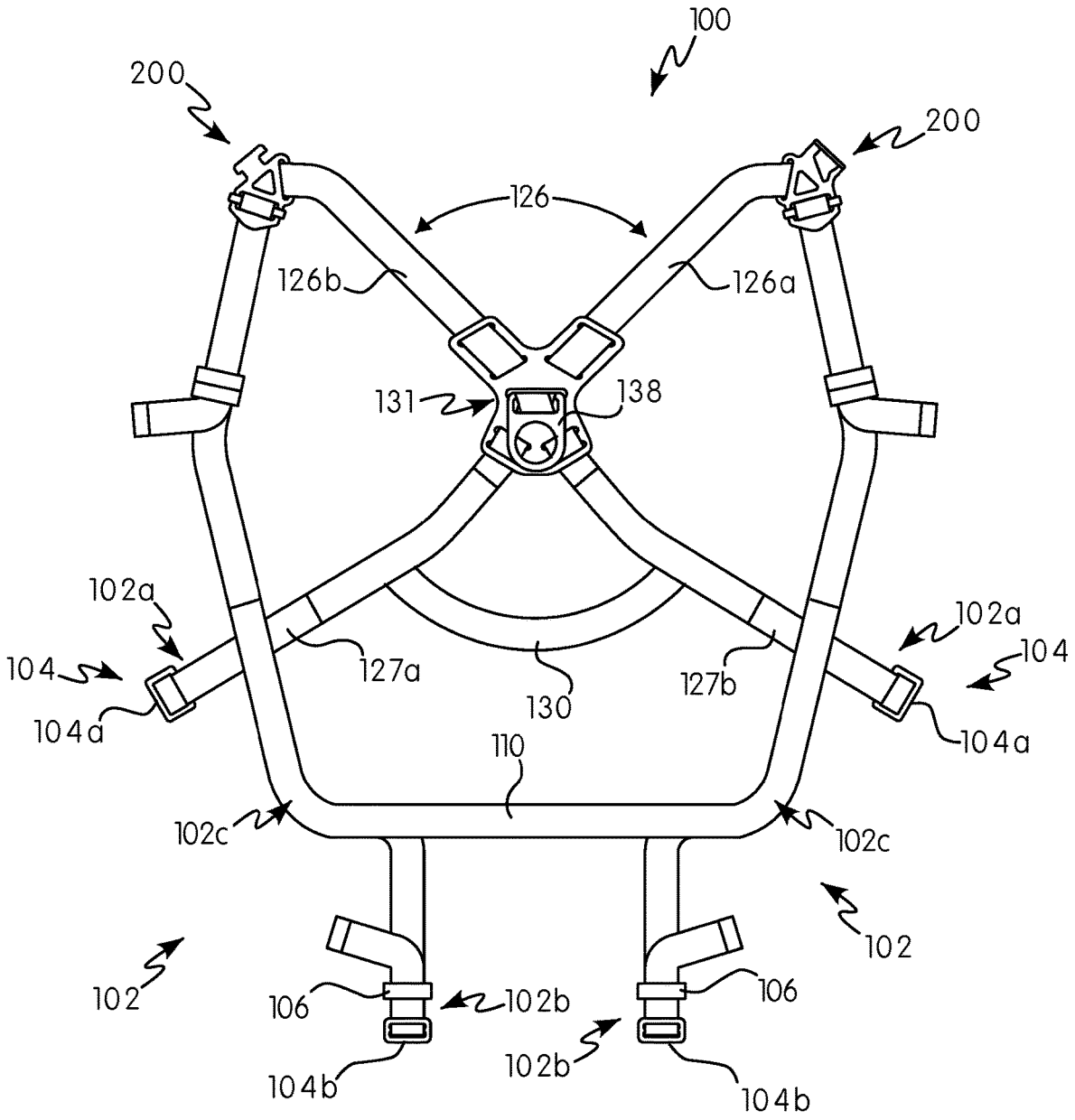
FIG. 1 is a front perspective view of a wearable body harness in accordance with one preferred and non-limiting embodiment or aspect of the present invention.

As used herein, the singular form of "a", "an", and "the" include plural referents unless the context clearly dictates otherwise.

Spatial or directional terms, such as "left", "right", "inner", "outer", "above", "below", and the like, relate to the invention as shown in the drawing figures and are not to be considered as limiting as the invention can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "adjacent" means proximate to but not in direct contact with.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of the invention may describe certain features as being "particularly" or "preferably" within certain limitations (e.g., "preferably", "more preferably", or "even more preferably", within certain limitations). It is to be understood that the invention is not limited to these particular or preferred limitations but encompasses the entire scope of the disclosure.

In various non-limiting embodiments or aspects, and with reference to FIG. 1, the present disclosure is directed to a safety harness 100 (hereinafter referred to as "harness 100") used in a fall protection system. As discussed herein, the harness 100 has a harness connection arrangement configured for releasably coupling at least a pair of straps of the harness 100. Preferably, the harness 100 has a harness connection arrangement for connecting at least two straps of the harness, wherein the harness connection arrangement can be easily and effectively connected and disconnected to allow quick donning and removal of the harness 100.

With continued reference to FIG. 1, the harness 100 has at least two leg straps 102 configured to attach around a user's legs below a user's groin area. When attached, the leg straps 102 loop around or encircle each of the user's legs. Each leg strap 102 has a first end 102*a* that is removably attachable to a second end 102*b* via a connector 104. In some non-limiting embodiments or aspects, the connector 104 may be a clip, a buckle, a mating arrangement, an actuatable structure, or the like. The connector 104 permits removable attachment of the first end 102*a* to the second end 102*b* of each leg strap 102. In this manner, the first and second ends 102*a*, 102*b* of the leg straps 102 are configured to be removably attached to each other and configured to be free floating when detached from each other. In some non-limiting embodiments or aspects, at least one connector 104 and/or the leg strap 102 may have at least one connection mechanism 106 configured for adjusting the length of each leg strap 102. In this manner, the at least one connection mechanism 106 adjusts a distance between the first end 102*a* and the second end 102*b* such that each leg strap 102 may be adjusted to fit comfortably around the user's legs. Each leg strap 102 may be formed from a substantially flat webbing material typically used in harness construction. One or more handles, clips, and/or connectors (not shown) may be provided on at least a portion of the harness 100. The harness 100 may include padding (not shown) for increasing the user's comfort while wearing the harness 100.

In various non-limiting embodiments or aspects, the leg straps 102 (or, indeed, any of the straps in the harness 100) may be linear lengths of material, folded straps that form loops with the at least one connector 104 at the first end 102*a* and/or the second end 102*b*, or the like. For example, as shown in FIG. 1, the connector 104 may have a first portion 104*b* that is adjustably attached to the first end 102*b* of at least one leg strap 102 through a loop of the material that makes up the leg strap 102, while a second portion 104*a* of the connector 104 is non-adjustably secured at the second end 102*a* of at least one leg strap 102. Therefore, in such an arrangement, the first portion 104*b* of the connector 104 and the loop of material that makes up the leg strap 102 at the second end 102*b* defines the at least one connection mechanism 106 for adjusting a length of the leg strap 102. It should be noted that the position of the connection mechanism 106 may be reversed such that the second portion 104*a* of the connector 104 is provided on the first end 102*b* of the leg strap 102. At least one leg strap 102 may include padding (not shown) for increasing the user's comfort while wearing the harness 100.

With continued reference to FIG. 1, each leg strap 102 is connected to a seat strap 110 at a substantially intermediate portion 102*c* of the leg strap 102 between the first end 102*a* and the second end 102*b*. In some non-limiting embodiments or aspects, the substantially intermediate portion 102*c* of the leg strap 102 may be directly and non-movably connected to a seat strap 110, such as being sewn directly to the seat strap 110. In other non-limiting embodiments or aspects, the substantially intermediate portion 102*c* of each leg strap 102 may be connected to the rear end of the seat strap 110 by a connection strap (not shown) to allow the substantially intermediate portion 102*c* of the leg strap 102 to slidably move along a front portion of the leg strap 102. Accordingly, the position of the leg straps 102 may be adjusted relative to the seat strap 110 to increase the user's comfort while wearing the harness 100.

With continued reference to FIG. 1, the harness 100 further has the shoulder strap 126 configured to extend over at least a portion of the user's shoulders. The shoulder strap 126 may have a first shoulder strap 126*a* and a second shoulder strap 126*b* arranged to overlap one another in an X-shaped configuration. In some non-limiting embodiments or aspects, the shoulder strap 126 may have at least one shoulder pad 131 having one or more openings through which the first shoulder strap 126*a* and the second shoulder strap 126*b* can be arranged to maintain the first shoulder strap 126*a* and the second shoulder strap 126*b* in the X-shaped configuration.

As further shown in FIG. 1, the first shoulder strap 126*a* has a first end 127*a* that is connected to the first end 102*a* of a first leg strap 102. The first end 127*a* of the first shoulder strap 126*a* may be removably or non-removably attachable to the first end 102*a* of a first leg strap 102. In some non-limiting embodiments or aspects, the first end 127*a* of the first shoulder strap 126*a* may be attached to the first end 102*a* of a first leg strap 102 via a connector similar to the connector 104 described herein with reference to the leg straps 102. At least a portion of the first shoulder strap 126*a* may be formed from a substantially flat webbing material typically used in harness construction.

With continued reference to FIG. 1, the second shoulder strap 126*b* has a first end 127*b* that is connected to the first end 102*a* of the second leg strap 102. The first end 127*b* of the second shoulder strap 126*b* may be removably or non-removably attachable to the first end 102*a* of the second leg strap 102. In some embodiments or aspects, the first end 127*b* of the second shoulder strap 126*b* may be attached to the first end 102*a* of the second leg strap 102 via a connector similar to the connector 104 described herein with reference to the leg straps 102. At least a portion of the second shoulder strap 126*b* may be formed from a substantially flat webbing material typically used in harness construction.

As further shown in FIG. 1, the harness 100 may have a back strap 130 connecting a substantially intermediate portion of the first shoulder strap 126*a* between its first end 127*a* with a substantially intermediate portion of the second shoulder strap 126*b* between its first end 127*b*. In some non-limiting embodiments or aspects, a position of the back strap 130 may be fixed relative to the shoulder straps 126*a*, 126*b*. In other non-limiting embodiments or aspects, a position of the back strap 130 may be adjustable along a longitudinal direction of the first shoulder strap 126*a* and the second shoulder strap 126*b*, such as by sliding the back strap 130 along the first shoulder strap 126*a* and/or the second shoulder strap 126*b*.

With continued reference to FIG. 1, the first and second shoulder straps 126*a*, 126*b* may be connectable together at a front portion of the harness 100 in an area of the user's chest. In some non-limiting embodiments or aspects, the first and second shoulder straps 126*a*, 126*b* may have at least one connection arrangement 200 further described herein with reference to FIGS. 2A-6B.

As further shown in FIG. 1, the shoulder strap 126 has an anchor element, such as a D-ring 138, for connecting at least a portion of the shoulder strap 126 to a line connected to an anchor point. In some non-limiting embodiments or aspects, at least a portion of the first shoulder strap 126*a* and the second shoulder strap 126*b* is looped around or otherwise permanently attached to the D-ring 138. The D-ring 138 has a frame defining at least one opening through which the first shoulder strap 126*a* and the second shoulder strap 126*b* may be looped around and through which a clip, such as a carabiner, a lanyard, or other rope or line, can be secured to connect the harness 100 to an anchor point.

With reference to FIGS. 2A-3C, the connection arrangement 200 for use with a wearable body harness, such as the harness 100 shown in FIG. 1, is shown in accordance with one preferred and non-limiting embodiment or aspect of the present invention. The connection arrangement 200 is illustrated without harness straps for clarity. While in some preferred and non-limiting embodiments or aspects of the present invention the connection arrangement 200 is configured for connecting portions of the shoulder strap 126 across the user's chest, the connection arrangement 200 can be used to connect any two or more straps of the harness 100.

With continued reference to FIGS. 2A-3C, the connection arrangement 200 has a first connector 202 removably connectable to a second connector 204. As described herein, the first and second connectors 202, 204 are engageable between a first, locked configuration, where the first and second connectors 202, 204 are connected to each other, and a second, unlocked configuration, where the first and second connectors 202, 204 are disconnected from each other. The first and second connectors 202, 204 can be connected to one another by actuating a locking mechanism, such as a tongue and clasp arrangement discussed herein. In various preferred and non-limiting embodiments or aspects, the connection arrangement 200 may be made from metal, plastic, a composite material, and any combination thereof.

Figure 4B:
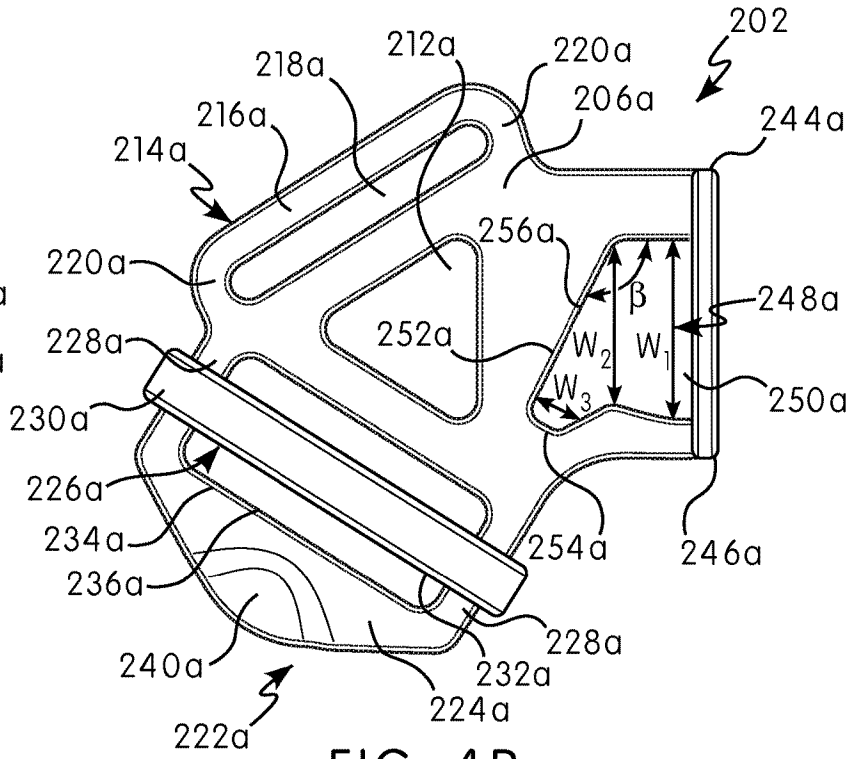
FIG. 4B is a front view of the first connector shown in FIG. 4A.
Figure 4A:
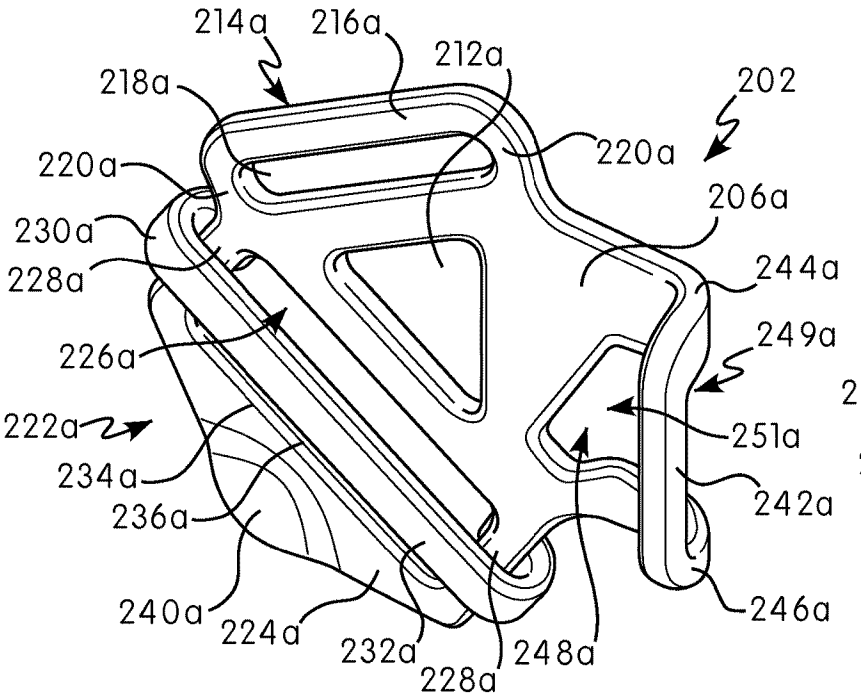
FIG. 4A is a front perspective view of a first connector of the harness connection arrangement of FIGS. 2A-2B.
Figure 4C:
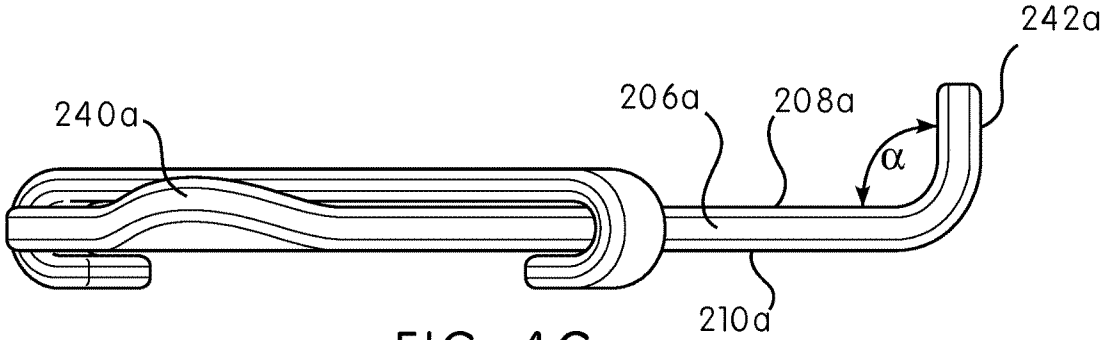
FIG. 4C is a side view of the first connector shown in FIG. 4A.

With reference to FIGS. 4A-4C, the first connector 202 is shown separate from the second connector 204 of the connection arrangement 200. The first connector 202 has a body 206*a* with a first side 208*a* opposite a second side 210*a* (shown in FIG. 4C). In some preferred and non-limiting embodiments or aspects, the first side 208*a* may face away from a body of the user while a second side 210*a* may face toward a body of the user when the first connector 202 is installed on a harness worn by the user. While FIGS. 4A-4C show the body 206*a* of the first connector 202 being substantially planar, the body 206*a* may have a non-planar shape in other preferred and non-limiting embodiments or aspects. The body 206*a* may be monolithically formed as a single, integral piece. In other preferred and non-limiting embodiments or aspects, the body 206*a* of the first connector 202 may be formed from two or more components that are removably or non-removably connected together. In various preferred and non-limiting embodiments or aspects, the body 206*a* of the first connector 202 may be made from metal, plastic, a composite material, and any combination thereof.

With reference to FIGS. 4A-4B, the body 206*a* of the first connector 202 has a substantially triangular shape. In other preferred and non-limiting embodiments or aspects, the body 206*a* may have any other shape, such as a circular shape, an oval shape, a rectangular shape, or any other regular or irregular geometric shape. In preferred and non-limiting embodiments or aspects, a relief opening 212*a* may be provided on the body 206*a* to reduce the weight of the first connector 202*a*. The relief opening 212*a* desirably extends through the body 206*a* between the first side 208*a* and the second side 210*a*. In some preferred and non-limiting embodiments or aspects, the relief opening 212*a* may be formed as a recess that is partially recessed into one or both of the first side 208*a* and the second side 210*a* of the body 206*a*. The relief opening 212*a* may be shaped to correspond to the shape of the body 206*a*. For example, in a body 206*a* having a substantially triangular shape, the relief opening 212*a* may have a corresponding substantially triangular shape. In some preferred and non-limiting embodiments or aspects, the relief opening 212*a* may have a shape that is different than the shape of the body 206*a* of the first connector 202. The relief opening 212*a* may be centered on the body 206*a* or offset toward any side of the body 206*a*.

With reference to FIGS. 4A-4B, the first connector 202 has at least one fixed buckle 214*a* connected to the body 206*a*. In some preferred and non-limiting embodiments or aspects, the at least one fixed buckle 214*a* may be connected to one of the three sides of the body 206*a* having a substantially triangular shape. The fixed buckle 214*a* is configured for receiving at least a portion of a harness webbing therethrough, such as at least a portion of the shoulder harness 126 and/or the chest strap 132. The fixed buckle 214*a* may have a bar 216*a* that is spaced apart from the body 206*a* of the first connector 202 such that the harness webbing may be inserted through a gap 218*a* formed between the bar 216*a* and the body 206*a*. The bar 216*a* is connected to the body 206*a* by posts 220*a*. The webbing is desirably looped through the gap 218*a* and around the bar 216*a* such that the webbing overlaps itself around the bar 216*a*. The overlapping ends of the webbing may be sewn together or otherwise attached to prevent removal of the webbing from the fixed buckle 214*a*.

In some preferred and non-limiting embodiments or aspects, the at least one fixed buckle 214*a* may be provided on an upper side and/or a lower side of the first connector 202 when the harness 100 (shown in FIG. 1) is worn by a user. In this manner, one or more straps may be connected to the at least one fixed buckle 216*a* from above or below the first connector 202. In FIGS. 4A-4B, the at least one fixed buckle 214*a* is provided on an upper side of the first connector 202 when the harness 100 is worn by the user.

With continued reference to FIGS. 4A-4B, the first connector 202 has at least one adjustable buckle 222*a* connected to the body 206*a*. In some preferred and non-limiting embodiments or aspects, the at least one adjustable buckle 222*a* may be connected to one of the three sides of the body 206*a* having a substantially triangular shape. The at least one adjustable buckle 222*a* is configured for receiving at least a portion of a harness webbing therethrough, such as at least a portion of the shoulder harness 126 (shown in FIG. 1). In some preferred and non-limiting embodiments or aspects, the at least one adjustable buckle 222*a* has an adjustment mechanism associated therewith to permit an adjustment of at least one strap of the harness 100 (shown in FIG. 1) that is connected to the at least one adjustable buckle 222*a*. The adjustment mechanism may be configured for permitting frictional adjustment of the at least one strap of the harness 100, as described herein.

Figure 6A:
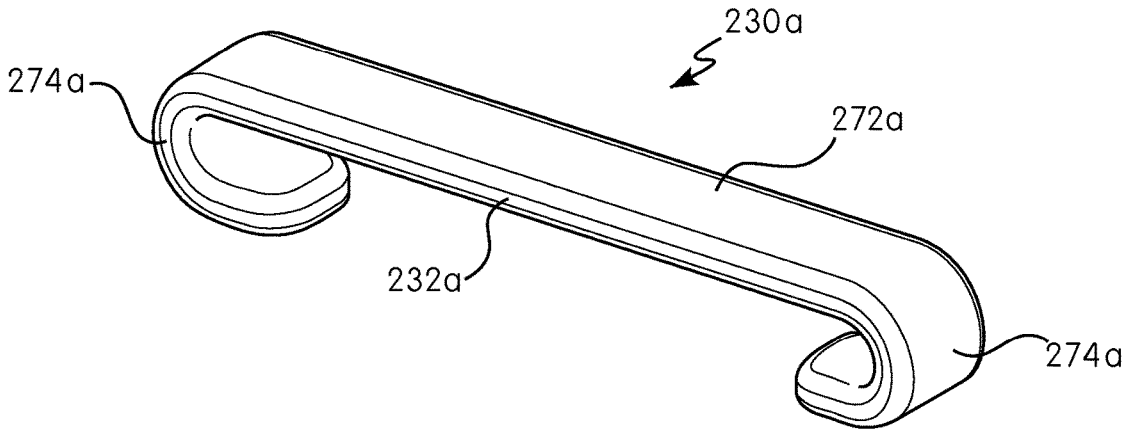
FIG. 6A is a front perspective view of an adjustment bar of the harness connection arrangement of FIGS. 2A-2B.
Figure 6B:
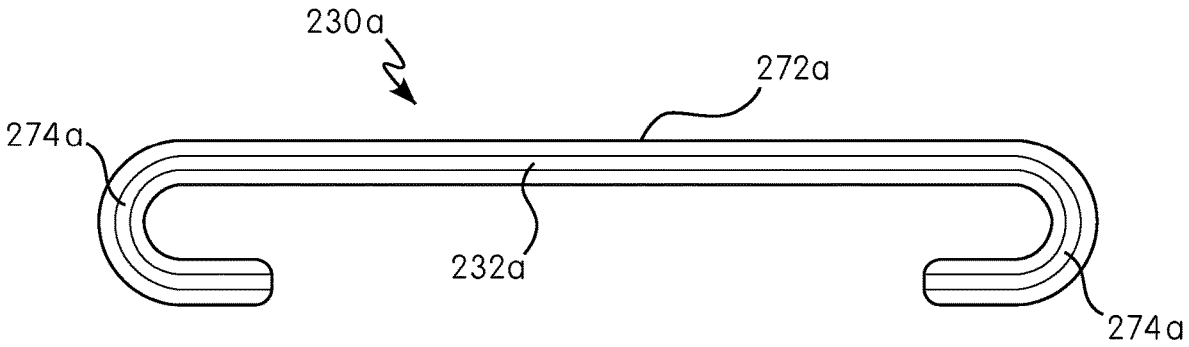
FIG. 6B is a side view of the adjustment bar shown in FIG. 6A.

With continued reference to FIGS. 4A-4B, the at least one adjustable buckle 222*a* may have a frame 224*a* that is spaced apart from the body 206*a* of the first connector 202 such that at least one strap of the harness 100 (shown in FIG. 1) may be inserted through an opening 226*a* formed between the frame 224*a* and the body 206*a*. The frame 224*a* is connected to the body 206*a* at its terminal ends 228*a*. The at least one adjustable buckle 222*a* further has an adjustment bar 230*a* configured to permit adjustable movement of at least one strap of the harness 100. The adjustment bar 230*a* extends across the opening 226*a* and is moveably engaged with the adjustable buckle 222*a*, such as by sliding contact with the terminal ends 228*a* of the frame 224*a*. The adjustment bar 230*a* is movable across the opening 226*a* between a first position closer to the body 206*a* of the first connector 202 and a second position further away from the body 206*a*. With reference to FIGS. 6A-6B, the adjustment bar 230*a* has an elongated body 272*a* with terminal ends 274*a* that are bent in a direction toward one another. The terminal ends 274*a* may be bent away from the body 274*a* in an arcuate shape.

Figure 6C:
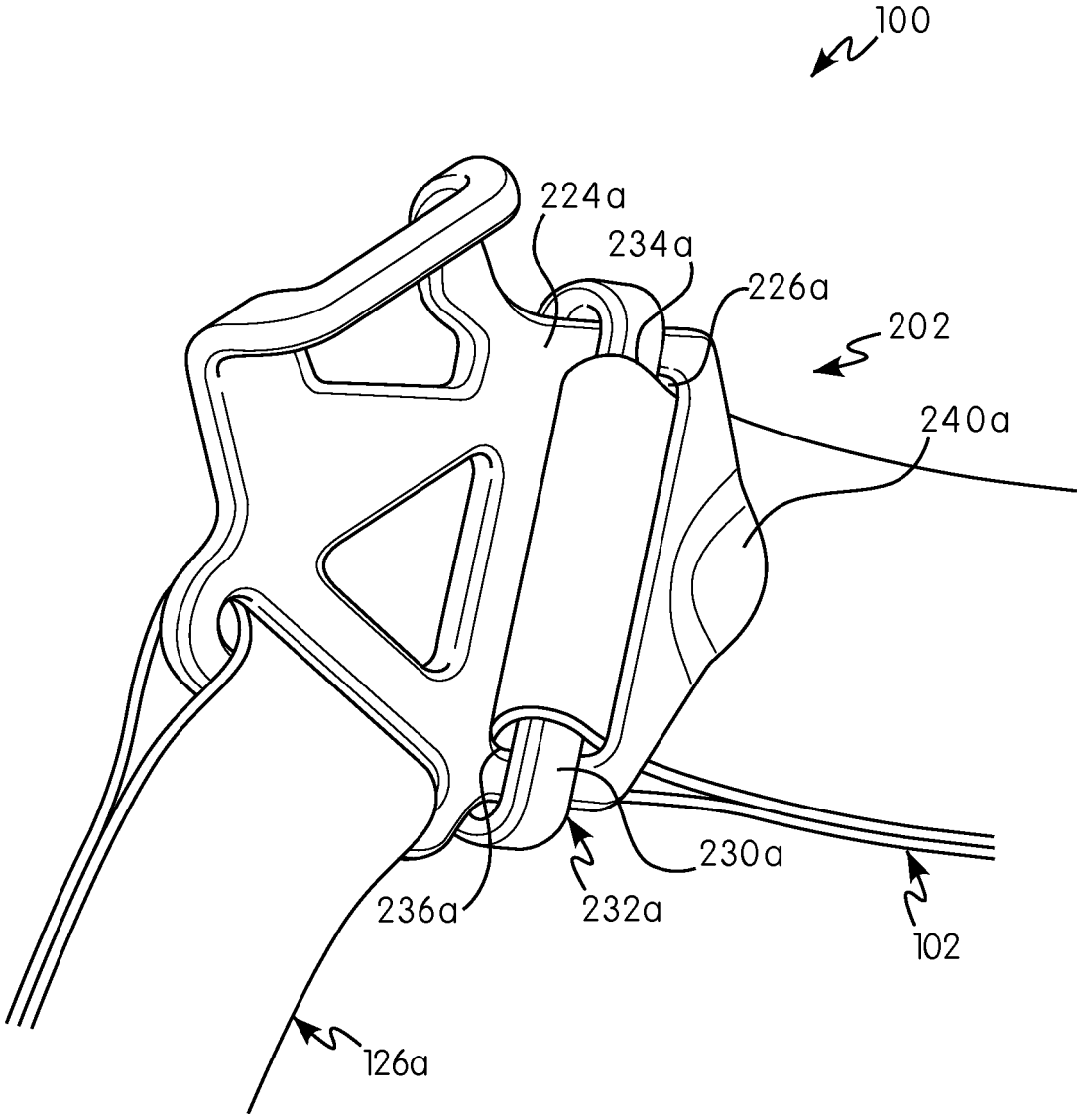
FIG. 6C, is a side perspective view of strap routing through an adjustment bar.

In use, and with reference to FIG. 6C, at least one strap 102 of the harness 100 is looped around the adjustment bar 230*a* and through the opening 226*a*. The adjustment bar 230*a* has a first contact surface 232*a* to contact a first surface of at least one strap 102 of the harness 100, while a first end 234*a* of the frame 224*a* has a second contact surface 236*a* to contact a second surface opposite the first surface of the at least one strap 102 of the harness 100 such that the at least one strap 102 is wedged between the first contact surface 232*a* and the second contact surface 236*a* when the adjustment bar 230*a* is in the second position. The frictional contact between the at least one strap and the first contact surface 232*a* and the second contact surface 236*a* prevents the strap from moving relative to the first connector 202. The first end 234*a* of the frame 224*a* has a lifting tab 240*a* configured to permit the user to grasp the first end 234*a* of the frame 224*a* and move it relative to the body of the user, such as in a direction up and away from the user's body. In some preferred and non-limiting embodiments or aspects, the lifting tab 240*a* may be formed as an arcuate bend in the frame 224*a* that is configured for being grasped by the user's fingers. Movement of the frame 224 due to engagement of the lifting tab 240*a* by the user's fingers changes an angle of at least one strap relative to the first contact surface 232*a* and the second contact surface 236*a* to allow the adjustment bar 230*a* to be moved to the first position, thereby allowing the at least one strap to movably adjust relative to the first connector 202.

In some preferred and non-limiting embodiments or aspects, the at least one adjustable buckle 222*a* may be provided on an upper side and/or a lower side of the first connectors 202 when the harness 100 (shown in FIG. 1) is worn by a user. In this manner, one or more straps may be connected to the at least one fixed buckle 216*a* from above or below the first connector 202. In FIGS. 4A-4B, the at least one adjustable buckle 222*a* is provided on a lower side of the first connector 202 when the harness 100 is worn by the user.

With continued reference to FIGS. 4A-4B, the first connector 202 has a first portion of a locking mechanism 201 (shown in FIGS. 2A-2B) configured for engaging the first connector 202 between the first, locked configuration, where the first connector 202 is connected to the second connector 204 (shown in FIGS. 3A-3B) and a second, unlocked configuration, where the first connector 202 is disconnected from the second connector 204. The first connector 202 has a tab 242*a* that is connected to the body 206*a* and is angled relative to a main plane of the body 206*a*. The tab 242*a* may be monolithically formed with the body 206*a* of the first connector 202, or may be removably or non-removably attached to the body 206*a*. In some preferred and non-limiting embodiments or aspects, the tab 242*a* may be angled at a substantially perpendicular angle relative to the main plane of the body 206*a* defined, for example, by at least one of the first side 208*a* and the second side 210*a* of the body 206*a*. In other preferred and non-limiting embodiments or aspects, the tab 242*a* may be angled at an angle $\alpha$ (shown in FIG. 4C) relative to the main plane of the body 206*a*. Angle $\alpha$ may be between 30° to 180°, preferably between 45° to 165°, more preferably between 60° to 150°, more preferably between 75° to 135°, and more preferably between 85° to 120°, such as approximately 90°.

With continued reference to FIGS. 4A-4B, the tab 242*a* has a first end 244*a* and a second end 246*a* connected to the body 206*a*. A slot 248*a* has a first portion 249*a* that extends through at least a portion of the body 206*a* between the first side 208*a* and the second side 210*a*. The slot 248*a* further has a second portion 251*a* that extends through the tab 242*a* between the first end 244*a* and the second end 246*a*. Together, the first portion 249*a* and the second portion 251*a* of the slot 248*a* define the first portion of the locking mechanism 201 (shown in FIGS. 2A-2B) and are shaped to receive a corresponding tongue on the second connector 204, as described herein. In some preferred and non-limiting embodiments or aspects, the first portion 249*a* of the slot 248*a* has a first end 250*a* opposite a second end 252*a*. The first end 250*a* may have a substantially uniform width $W_1$. The second end 252*a* of the first portion 249*a* of the slot 248*a* has a width $W_2$ that narrows in a direction away from the tab 242*a* and toward the body 206*a*. The "ramp" between $W_1$ and $W_2$ of the slot 248*a* may have a substantially constant width as the second connector 204 is rotated during disassembly so that the tongue of the second connector 204 is not accidentally removed from the slot 248*a* before the tongue is moved to the second end 252*a*.

In some preferred and non-limiting embodiments or aspects, the second end 252*a* of the first portion 249*a* of the slot 248*a* may be angled at an angle $\beta$ relative to a side surface of the first portion 249*a*. The second end 252*a* of the first portion 249*a* of the slot 248*a* further has a notch 254*a* at a terminal end thereof. The notch 254*a* is shaped and sized to receive a corresponding portion of the tongue of the second connector 204, as described herein. An angled surface 256*a* of the notch 254*a* has a width $W_3$ that is narrower than a width of the widest portion of the tongue of the second connector 204, as described herein. The angled surface 256*a* is angled to prevent accidental disassembly of the connection arrangement 200.

Figure 5B:
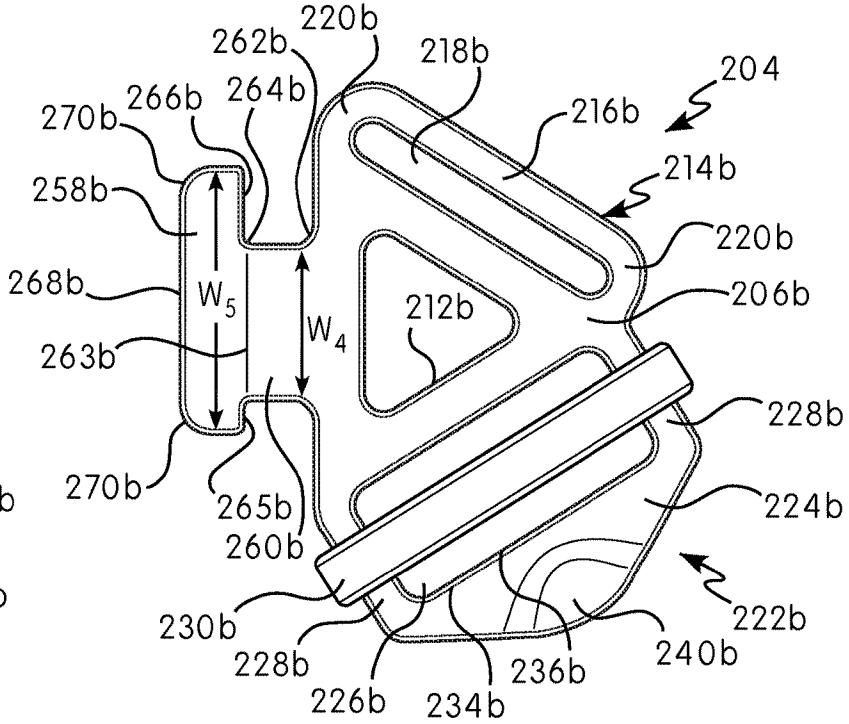
FIG. 5B is a front view of the second connector shown in FIG. 5A.
Figure 5A:
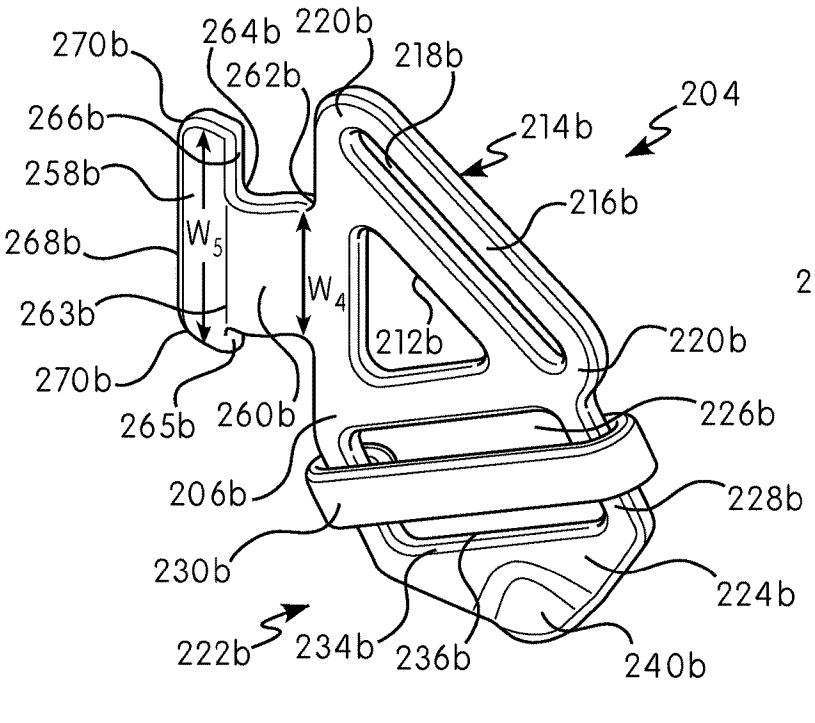
FIG. 5A is a front perspective view of a second connector of the harness connection arrangement of FIGS. 2A-2B.
Figure 5C:
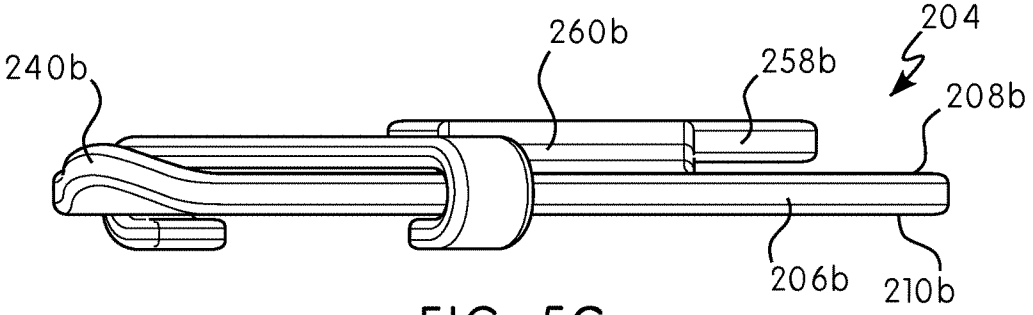
FIG. 5C is a side view of the second connector shown in FIG. 5A.

With reference to FIGS. 5A-5C, the second connector 204 is shown separate from the first connector 202 of the connection arrangement 200. Components of the second connector 204 shown in FIGS. 5A-5C are substantially similar or identical to the components of the first connector 202 described herein with reference to FIGS. 4A-4C. Reference numerals in FIGS. 5A-5C are used to illustrate identical components of the corresponding reference numerals in FIGS. 4A-4C, with the exception of an identifier "a" being replaced with an identifier "b". For example, whereas the body of the first connector 202 is identified with reference numeral 206*a*, the body of the second connector 204 is identified with reference numeral 206*b*. As the previous discussion regarding the first connector 202 generally shown in FIGS. 4A-4C is applicable to the second connector 204 shown in FIGS. 5A-5C, only the relative differences between the first and second connectors 202, 204 are discussed hereinafter.

With continued reference to FIGS. 5A-5C, the second connector 204 is shown separate from the first connector 202 of the connection arrangement 200. As described herein, the first and second connectors 202, 204 are engageable between a first, locked configuration, where the first and second connectors 202, 204 are connected to each other, and a second, unlocked configuration, where the first and second connectors 202, 204 are disconnected from each other. The first and second connectors 202, 204 can be connected to one another by actuating the locking mechanism, such as the tongue and slot arrangement discussed herein.

With continued reference to FIGS. 5A-5C, the second connector 204 has a body 206*b* with a first side 208*b* opposite a second side 210*b*. In some preferred and non-limiting embodiments or aspects, the first side 208*b* may face away from a body of the user while a second side 210*b* may face toward a body of the user when the second connector 204 is installed on a harness worn by the user. While FIGS. 5A-5C show the body 206*b* of the second connector 204 being substantially planar, the body 206*b* may have a non-planar shape. In some preferred and non-limiting embodiments or aspects, the body 206*b* may have a shape that corresponds to the shape of the body 206*a* of the first connector 202. For example, the body 206*b* of the second connector 204 may be a mirror image of the body 206*a* of the first connector 202.

Figure 2A:
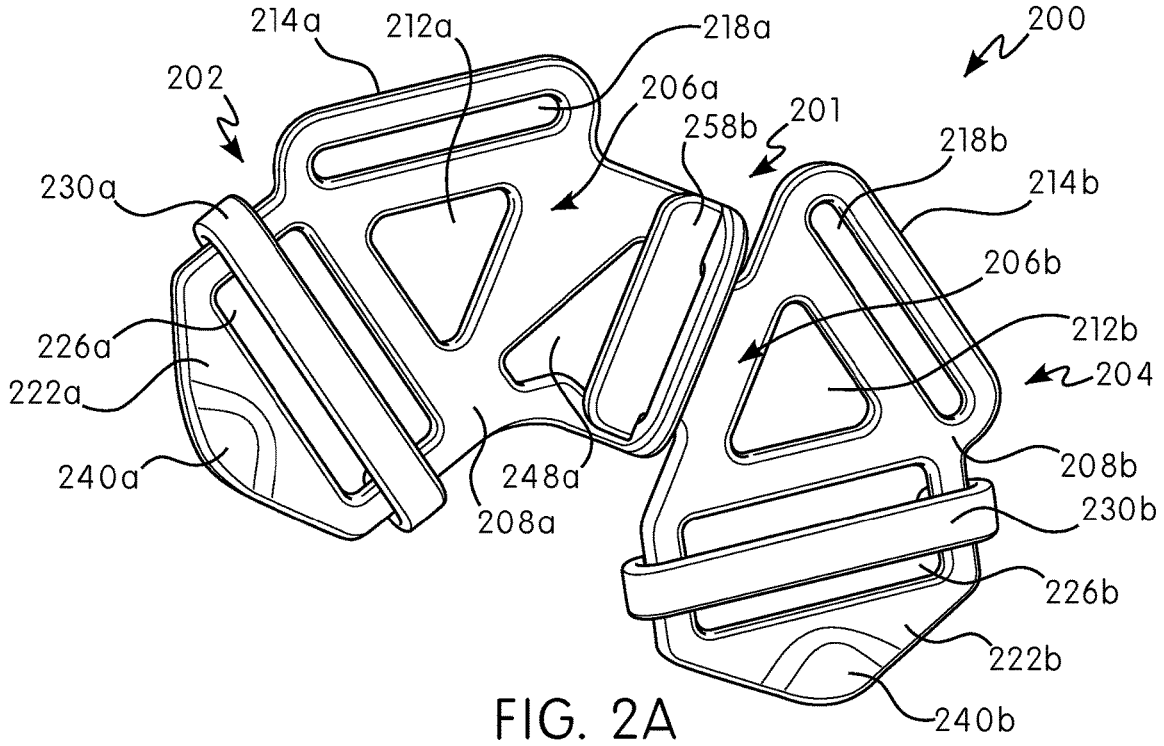
FIG. 2A is a front perspective view of a harness connection arrangement for use with a wearable body harness in accordance with one preferred and non-limiting embodiment or aspect of the present invention showing a first connector and a second connector connected to each other.
Figure 2B:
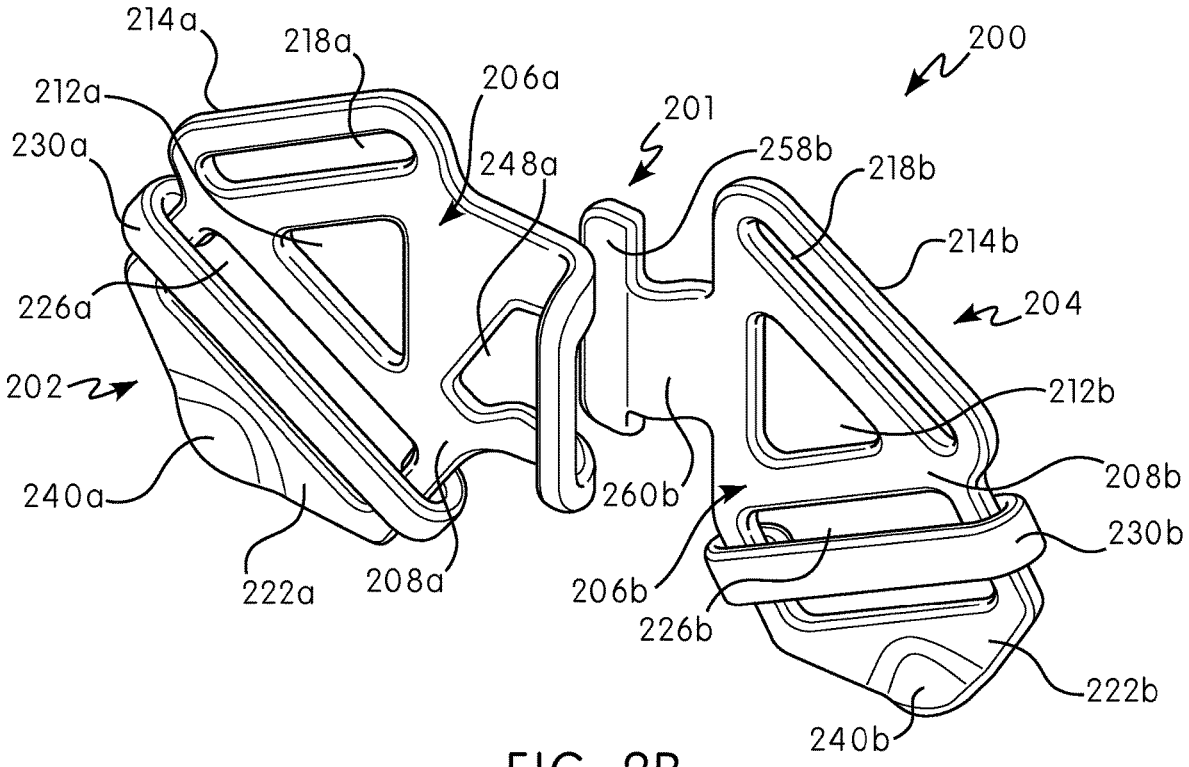
FIG. 2B is a front perspective view of the harness connection arrangement of FIG. 2A showing the first connector and the second connector disconnected from each other.
Figure 3A:
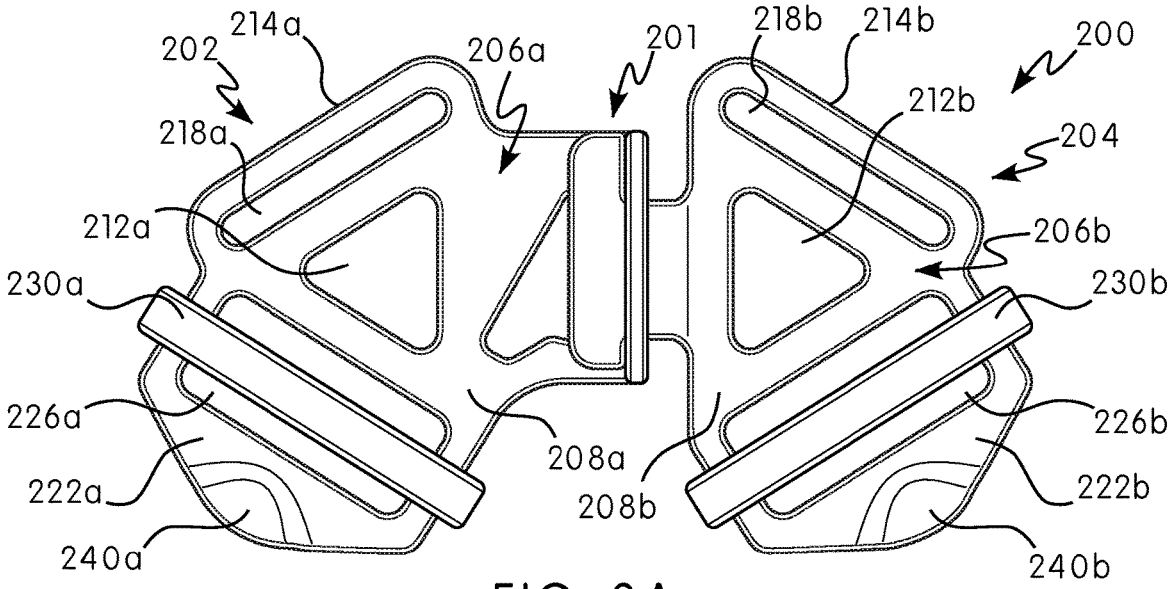
FIG. 3A is a front view of the harness connection arrangement shown in FIG. 2A.
Figure 3B:
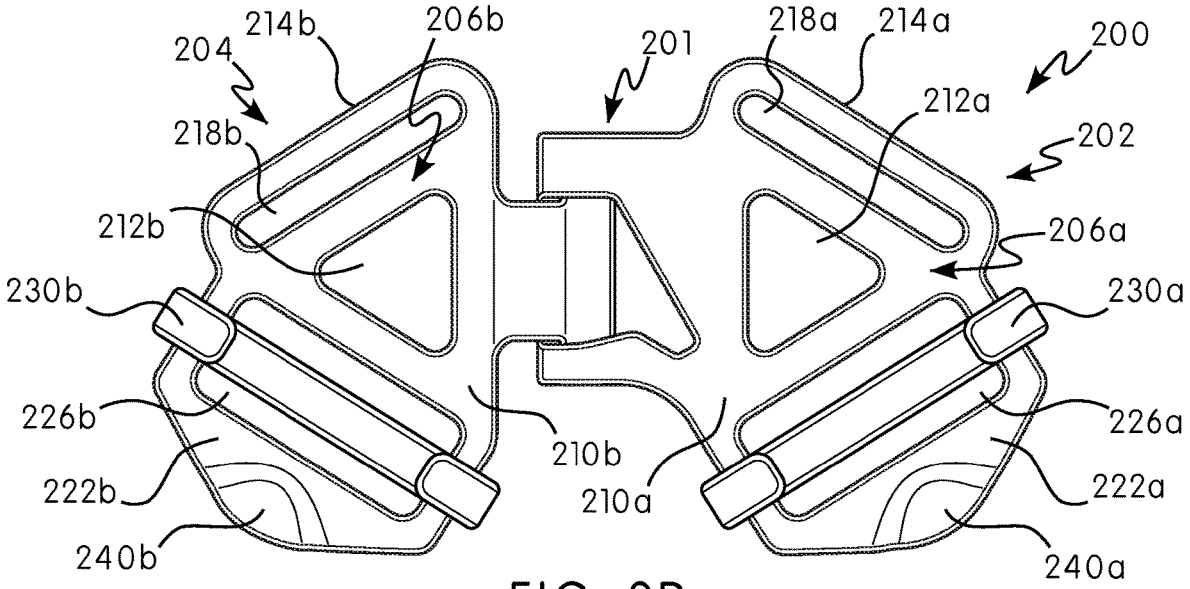
FIG. 3B is a rear view of the harness connection arrangement shown in FIG. 2A.
Figure 3C:
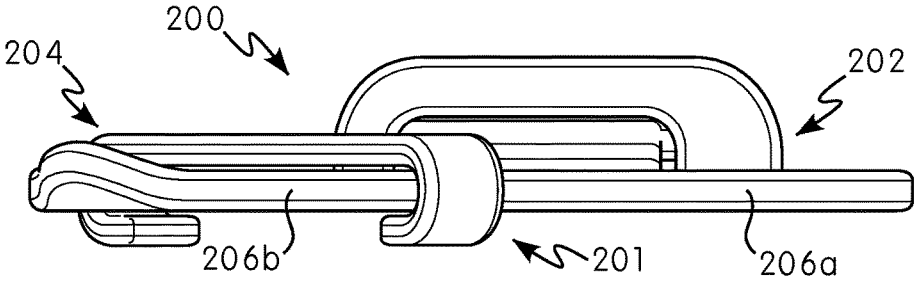
FIG. 3C is a side view of the harness connection arrangement shown in FIG. 2A.

With continued reference to FIGS. 5A-5C, the second connector 204 has a second portion of the locking mechanism 201 (shown in FIGS. 2A-2B) configured for engaging with the first portion of the locking mechanism 201 on the first connector 202 between the first, locked configuration, where the first connector 202 is connected to the second connector 204 (shown in FIG. 2A) and a second, unlocked configuration, where the first connector 202 is disconnected from the second connector 204 (shown in FIG. 2B). In some preferred and non-limiting embodiments or examples, the second portion of the locking mechanism 201 may be defined by a tongue 258*b* connected to the body 206*b* by an intermediate connecting element 260*b*. The tongue 258*b* may be offset from a plane defined by the body 206*b* by the intermediate connecting element 260*b*. For example, the intermediate connecting element 260*b* may have a first end 262*b* connected to the body 206*b* and a second end 264*b* opposite the first end 262*b*, wherein the second end 264*b* is in an offset plane relative to the first end 262*b*. In some preferred and non-limiting embodiments or aspects, the intermediate connecting element 260*b* may have an S-shape, an L-shape, or other geometric shape wherein one side thereof is in an offset plane relative to another side thereof. In some preferred and non-limiting embodiments or aspects, the second end 264*b* of the intermediate connecting element 260*b* is offset from the body 206*b* such that the tongue 258*b* is aligned with the first portion 250*a* of the slot 248*a* on the first connector 202 when the first connector 202 and the second connector 204 are connected together in a locked configuration.

A width $W_4$ of the intermediate connecting element 260*b* may be substantially uniform along its length. The width $W_4$ of the intermediate connecting element 260*b* is narrower than the width $W_1$ of the first end 250*a* of the first portion 249*a* of the slot 248*a* (shown in FIGS. 4A-4B) such that the intermediate connecting element 260*b* may be received within the first end 250*a* of the slot 248*a* when the first connector 202 and the second connector 204 are connected together.

With continued reference to FIGS. 5A-5C, the tongue 258*b* is connected to the intermediate connecting element 260*b* at a first elongated side 263*b*. In some preferred and non-limiting embodiments or aspects, a width $W_5$ of the first elongated side 263*b* may be wider than the width $W_4$ of the intermediate connecting element 260*b* such that the first elongated side 263*b* of the tongue 258*b* has at least a portion that overlaps the intermediate connecting element 260*b*. The first elongated side 263*b* of the tongue 258*b* may be positioned relative to the intermediate connecting element 260*b* such that it overlaps the intermediate connecting element 260*b* on both sides of the intermediate connecting element 260*b*. In some preferred and non-limiting embodiments or aspects, the first elongated side 263*b* of the tongue 258*b* may have a first portion 265*b* on a first side of the intermediate connecting element 260*b* and a second portion 266*b* on a second side of the intermediate connecting element 260*b*. A width of the first portion 265*b* of the first elongated side 263*b* may be shorter than a width of the second portion 266*b* of the first elongated side 263*b* so that the second portion 266*b* cannot be removed through the second end 252*a* of the first connector 202 before the first portion 265*b* is removed. The natural tendency of this connection is to separate with the second portion 266*b* coming out first. To reduce accidental separation, the second portion 266*b* can be made wider than the first portion 265*a* so that the second portion 266*b* cannot come out first. In some preferred and non-limiting embodiments or aspects, the width of the first and second portions 265*b*, 266*b* of the first elongated side 263*b* may be the same.

With continued reference to FIGS. 5A-5C, the tongue 258*b* has a second elongated side 268*b* opposite the first elongated side 263*b*. A width of the second elongated side 268*b* may be substantially identical to the width $W_5$ of the first elongated side 263*b*. In some preferred and non-limiting embodiments or aspects, the second elongated side 268*b* has at least one rounded corner, such as a pair of rounded corners 270*b*. In some preferred and non-limiting embodiments or aspects, the overall width of the tongue 258*b* is wider than the width $W_3$ of the angled surface 256*a* of the notch 254*a* on the first connector 202 (shown in FIGS. 4A-4B) such that the tongue 258*b* can only be inserted into and removed from the slot 248*a* by moving the tongue 258*b* at an angle relative to the slot 248*a*.

Figure 7A:
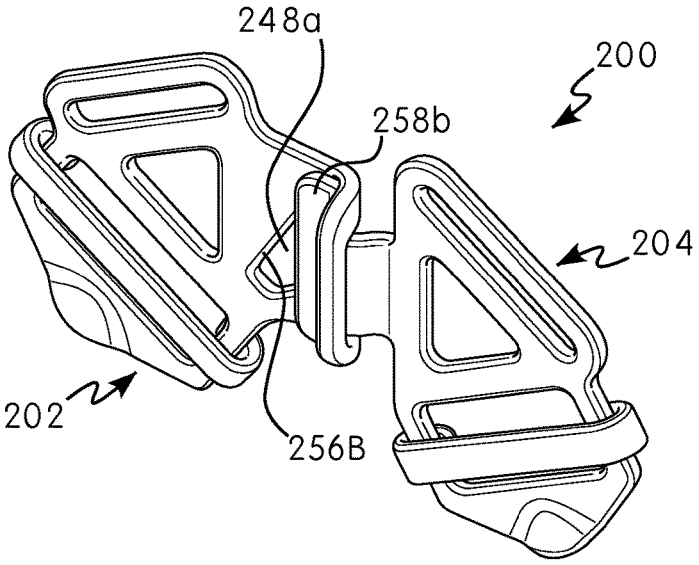
FIGS. 7A-7E are various front perspective views of the harness connection arrangement as the first connector and the second connector as disconnected from each other.
Figure 7B:
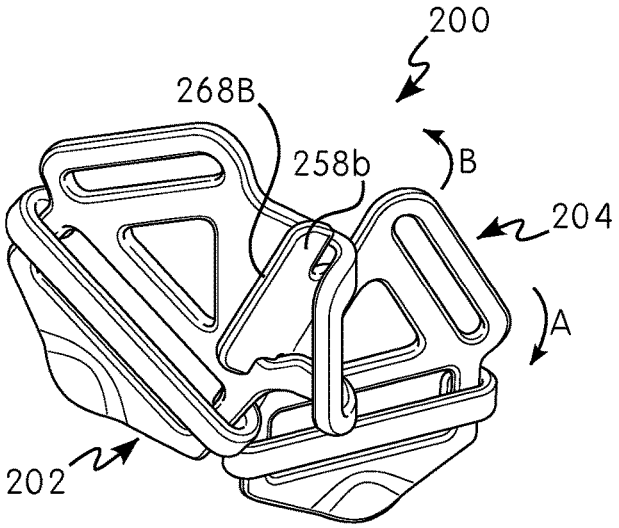
Figure 7C:
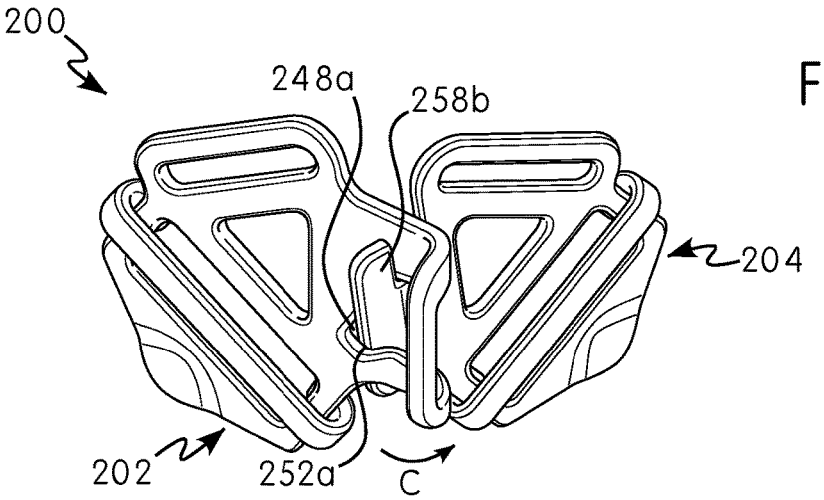
Figure 7D:
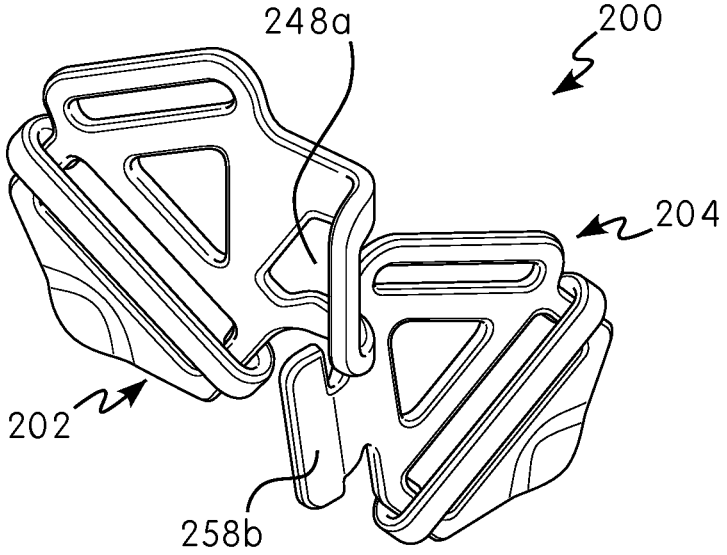
Figure 7E:
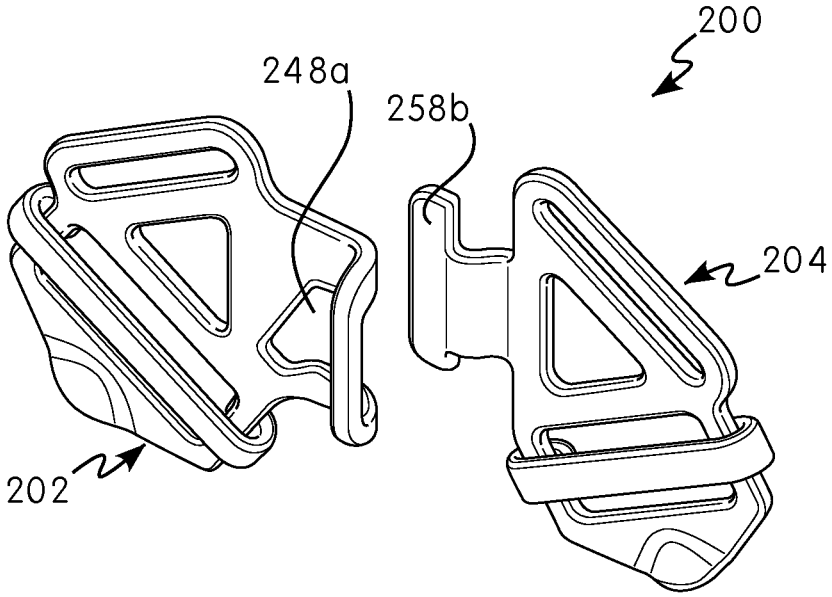

Having described the structure of the connection arrangement 200 with reference to FIGS. 4A-5C, a method of connecting the first connector 202 to the second connector 204 and disconnecting the first connector 202 from the second connector 204 will now be described with reference to FIGS. 7A-7E. Referring initially to FIG. 7A, the connection arrangement 200 is shown in a locked configuration, where the first and second connectors 202, 204 are connected to each other. While straps of the harness 100 (shown in FIG. 1) are omitted from FIGS. 7A-7E for clarity, when the first and second connectors 202, 204 are in the unlocked configuration, at least two straps of the harness 100, such as the shoulder straps 126, are disconnected from each other to allow for putting on or removing the harness 100 from the user's body. As described herein, the first and second connectors 202, 204 can be disconnected from each other by rotating the connectors 202, 204 relative to one another in a direction of arrow A about the planes defined by the bodies of the first and second connectors 202, 204. The second connector 204 is then rotated in a direction of arrow B relative to the first connector 202 such that the plane defined by the body 206*b* of the second connector 204 is angled relative to the plane defined by the body 206*a* of the first connector 202 until the second elongated side 268*b* of the tongue 258*b* on the second connector 204 is substantially parallel with the angled surface 256*a* on the slot 248*a* of the first connector 202 (FIG. 7B). This allows the tongue 258*a* to be removed through the second end 252*a* of the slot 248*a* to disconnect the second connector 204 from the first connector 202 (FIG. 7C). The first connector 202 can then be freely removed from the second connector 204 (FIGS. 7D-7E).

To connect the first connector 202 to the second connector 204, the tongue 258*b* and the intermediate connecting element 260*b* of the second connector 204 are inserted into the slot 248*a* in the first connector 202 by, for example, positioning the first connector 202 relative to the second connector 204 as shown in FIG. 7C. In some preferred and non-limiting embodiments or aspects, the first and second connectors 202, 204 can be aligned in such manner by, for example, rotating one or both of the first and second connectors 202, 204 until the second elongated side 268*b* of the tongue 258*b* on the second connector 204 is substantially parallel with the angled surface 256*a* on the slot 248*a* of the first connector 202. Because the tongue 258*b* is wider than the width of the slot 248*a*, the tongue 258*b* cannot be inserted into the slot 248*a* without rotating the second connector 204 such that the plane defined by the body 206*b* of the second connector 204 is angled relative to the plane defined by the body 206*a* of the first connector 202 (FIG. 7B). This allows the tongue 258*b* to be inserted into the second end 252*a* of the slot 248*a*. Upon insertion of a first portion of the tongue 258*b*, the second portion of the tongue 258*b* is rotated to also insert the second portion of the tongue 258*b* into the slot 248*a* (FIG. 7A). The first and second connectors 202, 204 are then connected together such that the tongue 258*b* cannot be removed from the slot 248*b* without deliberately aligning the first and second connectors 202, 204 as described herein.

Although the invention has been described in detail for the purpose of illustration based on what are currently considered to be the most practical, preferred, and non-limiting embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A connection arrangement for use with a wearable body harness, the connection arrangement comprising:

a first connector having a body with a first portion of a locking mechanism; and a second connector having a body with a second portion of the locking mechanism, wherein the first portion of the locking mechanism comprises:

a tab connected to the body of the first connector and angled at a predetermined angle relative to a plane defined by the body, and a slot having a first slot portion extending through the body of the first connector and a second slot portion extending through the tab and being continuous with the first slot portion, and wherein the second portion of the locking mechanism comprises:

a tongue configured for being received through the first slot portion, and an intermediate connecting element having a first end connected to the body of the second connector and a second end connected to the tongue, the second end of the intermediate connecting element being offset from the body of the second connector such that the intermediate connecting element is receivable in the second slot portion on the tab, wherein the tongue is connected to the intermediate connecting element along a first elongated side that is wider than a width of the intermediate connecting element, wherein the first elongated side has a first part overlapping a first side of the intermediate connecting element and a second part overlapping a second side of the intermediate connecting element, and wherein a width of the first part of the first elongated side is shorter than a width of the second part of the first elongated side.

2. The connection arrangement of claim 1, wherein the first portion of the locking mechanism is configured for interacting with the second portion of the locking mechanism to removably engage the first connector and the second connector between a first, locked configuration, where the first connector and the second connector are connected to each other, and a second, unlocked configuration, where the first connector and the second connector are disconnected from each other.

3. The connection arrangement of claim 1, wherein the predetermined angle is 30° to 180°.

4. The connection arrangement of claim 1, wherein the first slot portion has an angled end surface that is angled at an angle of 90° to 180° relative to lateral surfaces of the first slot portion.

5. The connection arrangement of claim 1, wherein a width of the first slot portion is narrower than a width of the tongue.

6. The connection arrangement of claim 1, wherein a width of the second slot portion is wider than a width of the intermediate connecting element.

7. The connection arrangement of claim 1, wherein the body of each of the first connector and the second connector comprises at least one fixed buckle configured for receiving at least a portion of a harness webbing therethrough.

8. The connection arrangement of claim 7, wherein the at least one fixed buckle has a bar spaced apart from the body of each of the first connector and the second connector by a gap and a pair of posts connecting terminal ends of the bar to the body of each of the first connector and the second connector.

9. The connection arrangement of claim 1, wherein the body of each of the first connector and the second connector comprises at least one adjustable buckle configured for receiving at least a portion of a harness webbing therethrough, the adjustable buckle having an adjustment mechanism configured for adjusting a position of at least one strap of the harness by selective frictional engagement with the at least one strap of the harness.

10. The connection arrangement of claim 9, wherein the adjustment mechanism comprises a frame connected at its terminal ends to the body of each of the first connector and the second connector with an opening between a central portion of the frame and the body of each of the first connector and the second connector, and an adjustment bar extending across the opening and movably engaged with the terminal ends of the frame.

11. The connection arrangement of claim 10, wherein the adjustment bar has an elongated body with terminal ends curved in a direction toward one another.

12. The connection arrangement of claim 10, wherein the frame has a lifting tab configured as an arcuate bend in the frame.

13. The connection arrangement of claim 1, wherein the body of at least one of the first connector and the second connector is substantially planar.

14. The connection arrangement of claim 1, further comprising a relief opening extending through the body of at least one of the first connector and the second connector.

15. A wearable body harness having a plurality of straps comprising:

a first shoulder strap and a second shoulder strap;

a first connector on the first shoulder strap, the first connector having a body with a first portion of a locking mechanism; and a second connector on the second shoulder strap, the second connector having a body with a second portion of the locking mechanism, wherein the first shoulder strap and the second shoulder strap are removably connectable to each other with engagement of the first connector and the second connector, and wherein the first portion of the locking mechanism comprises:

a tab connected to the body of the first connector, and a slot having a first slot portion extending through the body of the first connector and a second slot portion extending through the tab and being continuous with the first slot portion, and wherein the second portion of the locking mechanism comprises:

a tongue configured for being received through the first slot portion on the first connector, and an intermediate connecting element having a first end connected to the body of the second connector and a second end connected to the tongue, the second end of the intermediate connecting element being receivable in the second slot portion on the tab, wherein the tongue is connected to the intermediate connecting element along a first elongated side that is wider than a width of the intermediate connecting element, wherein the first elongated side has a first part overlapping a first side of the intermediate connecting element and a second part overlapping a second side of the intermediate connecting element, and wherein a width of the first part of the first elongated side is shorter than a width of the second part of the first elongated side.

16. The wearable body harness of claim 15, wherein the first shoulder strap has a first portion connected to a first end of the first connector and a second portion connected to a second end of the first connector, and wherein the second shoulder strap has a first strap portion connected to a first end of the second connector and a second strap portion connected to a second end of the second connector.

17. The wearable body harness of claim 15, wherein the first shoulder strap and the second shoulder strap are arranged in an X-shaped configuration at a front portion of the harness.

* * * * *